US008602831B2

(12) United States Patent
Miyawaki

(10) Patent No.: US 8,602,831 B2
(45) Date of Patent: Dec. 10, 2013

(54) TERMINAL HAVING HANGING PARTS FROM THE SIDES AND ONE END

(75) Inventor: Koji Miyawaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 27 days.

(21) Appl. No.: 13/541,367

(22) Filed: Jul. 3, 2012

(65) Prior Publication Data

US 2013/0017728 A1 Jan. 17, 2013

(30) Foreign Application Priority Data

Jul. 13, 2011 (JP) ..... 2011-154724

(51) Int. Cl.
*H01R 4/10* (2006.01)

(52) U.S. Cl.
USPC ..... 439/877

(58) Field of Classification Search
USPC ..... 439/877, 883, 358, 374, 345, 752
See application file for complete search history.

(56) References Cited

U.S. PATENT DOCUMENTS

| | | | | |
|---|---|---|---|---|
| 5,664,961 | A * | 9/1997 | Tsuji et al. | 439/358 |
| 7,811,140 | B2 * | 10/2010 | Tabata et al. | 439/877 |
| 7,828,612 | B2 * | 11/2010 | Kumakura | 439/877 |
| 7,938,699 | B2 * | 5/2011 | Okano | 439/877 |
| 8,105,121 | B2 * | 1/2012 | Miyamoto et al. | 439/883 |
| 2013/0029516 | A1 * | 1/2013 | Miyawaki | 439/352 |

FOREIGN PATENT DOCUMENTS

| | | | |
|---|---|---|---|
| JP | 5-62730 | A | 3/1993 |
| JP | 8-17508 | A | 1/1996 |
| JP | 9-199244 | A | 7/1997 |
| JP | 2006-107800 | A | 4/2006 |

* cited by examiner

*Primary Examiner* — Chandrika Prasad
(74) *Attorney, Agent, or Firm* — Kenealy Vaidya LLP

(57) ABSTRACT

There is provided a terminal of a connector which is surface-mounted on a substrate. A pair of first hanging-down parts extend from both sides of a terminal main body toward the substrate and are connected to a conductor pattern of the substrate. A second hanging-down part hangs down from one end of the terminal main body toward the substrate. The second hanging-down part has a pair of pressing plate portions which are bent toward the first hanging-down parts and is arranged to face each other with overlapping and contacting the first hanging-down parts.

3 Claims, 6 Drawing Sheets

TERMINAL HAVING HANGING PARTS FROM THE SIDES AND ONE END

The disclosure of Japanese Patent Application No. 2011-154724 filed on Jul. 13, 2011, including specification, drawings and claims is incorporated herein by reference in its entirety.

BACKGROUND

The present invention relates to a terminal that is surface-mounted on a substrate and a connector having the same.

Regarding a terminal to which a wire harness is connected in an automobile and the like, Patent Documents 1 and 2 disclose a structure where a separate member supports a bent contact from an outside of the bent contact.

Also, Patent Document 3 discloses a structure having an opening prevention claw having a function of preventing an insertion guide plate, which guides a terminal of a connection correspondent, from being opened.

Also, Patent Document 4 discloses a shielded connector for a substrate including an outer conductor terminal having a substrate-side connection portion to be insertion-connected into a through-hole of a printed substrate.

Patent Document 1: JP-A-8-17508
Patent Document 2: JP-A-5-62730
Patent Document 3: JP-A-9-199244
Patent Document 4: JP-A-2006-107800

Patent Documents 1 to 3 disclose a structure where a contact of the other party is arranged at one side and a core wire of an electric cable is arranged at the other side. Thus, it is not possible to conductively connect a conductor of a cable and a conductive pattern of a substrate. That is, the structure does not have a function serving as a terminal of a connector for a substrate for connecting a cable to a substrate.

According to the technology disclosed in Patent Document 4, a leg portion consisting of the substrate-side connection portion is inserted and attached into the through-hole of the substrate. Hence, it is not possible to cope with a surface mounting to the substrate.

SUMMARY

It is thereof an object of the present invention is to provide a terminal that can be mounted on a substrate smoothly and precisely without rattling by a surface mounting, and a connector having the terminal.

According to a first aspect of the embodiments of the present invention, there is provided a terminal of a connector which is surface-mounted on a substrate, the terminal comprising: a terminal body; a pair of first hanging-down parts extending from both sides of the terminal main body toward the substrate and being connected to a conductor pattern of the substrate; and a second hanging-down part hanging down from one end of the terminal main body toward the substrate, wherein the second hanging-down part has a pair of pressing plate portions which are bent toward the first hanging-down parts and is arranged to face each other with overlapping and contacting the first hanging-down parts.

In the terminal having the above configuration, the pair of first hanging-down parts that is connected to the substrate is held by the pressing plate portions of the second hanging-down part. Therefore, when correcting and surface mounting the first hanging-down parts on the substrate, it is possible to position the first hanging-down parts smoothly and precisely without rattling.

The pressing plate portions may be formed with engaging holes, and the first hanging-down parts may be formed with engaging piece portions which are engaged into the engaging holes.

In the terminal having the above configuration, the engaging piece portions are engaged into the engaging holes. Hence, it is possible to prevent the rattling of the second hanging-down part and to perform the surface mounting on the substrate while positioning the first hanging-down parts more smoothly and precisely.

According to a second aspect of the embodiments of the present invention, there is provided a connector accommodating the above-described terminal in a housing thereof, wherein the housing has engaging concave portions in which the pressing plate portions overlapping the first hanging-down parts are fitted.

In the connector having the above configuration, the pressing plate portions overlapping the first hanging-down parts are fitted and held in the engaging concave portions without rattling. Hence, it is possible to further prevent the rattling of the first hanging-down parts. Also, it is possible to prevent the rattling of the terminal with respect to the housing and to position and surface-mount the terminal on the substrate smoothly and precisely.

According to the invention, it is possible to provide a terminal that can be mounted on a substrate smoothly and precisely without rattling by a surface mounting, and a connector having the terminal.

BRIEF DESCRIPTION OF THE DRAWINGS

In the accompanying drawings:

FIGS. 4A to 4C show a shape of the outer conductor terminal, in which FIG. 4A is a plan view, FIG. 4B is a front view and FIG. 4C is a side view.

DETAILED DESCRIPTION OF THE EMBODIMENTS

Hereinafter, an illustrative embodiment of an outer conductor terminal and a connector having the same of the invention will be described with reference to the drawings.

Figure 1:
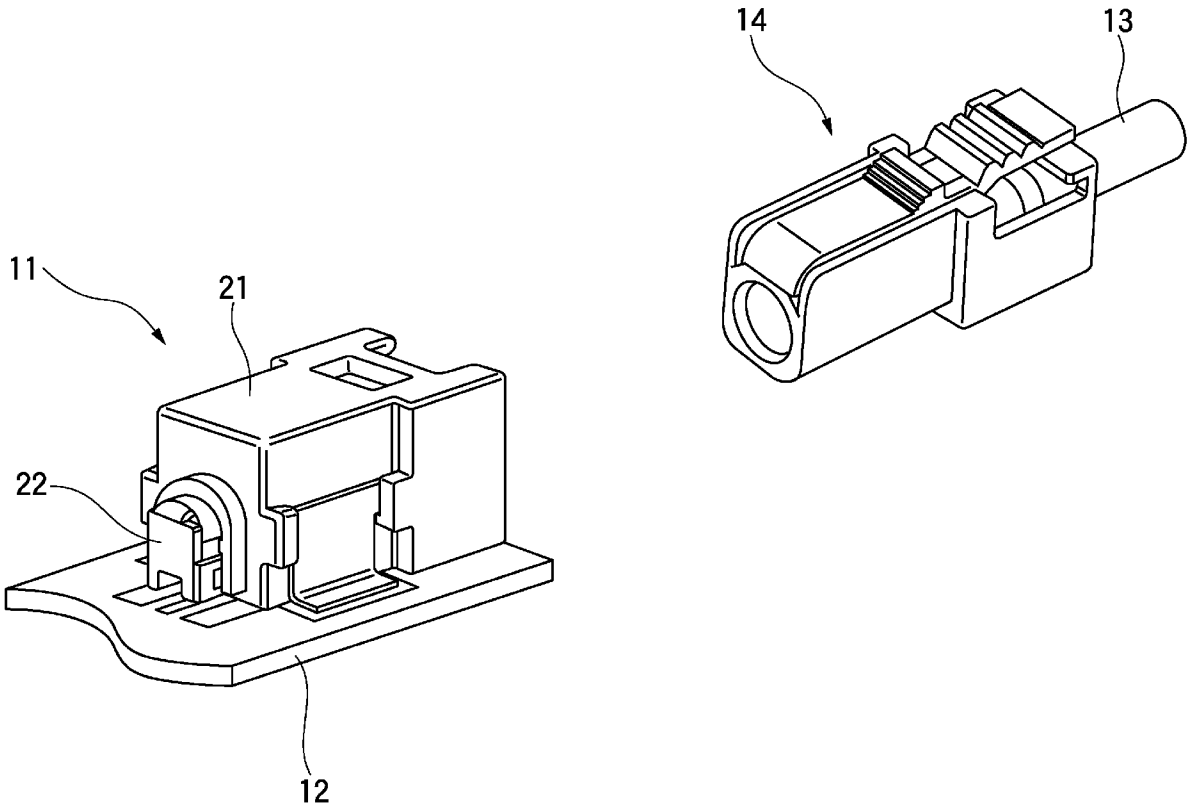
FIG. 1 is a perspective view of a shielded connector for a substrate and a cable-side connector that is connected to the shielded connector for a substrate according to an illustrative embodiment of the invention.
Figure 2:
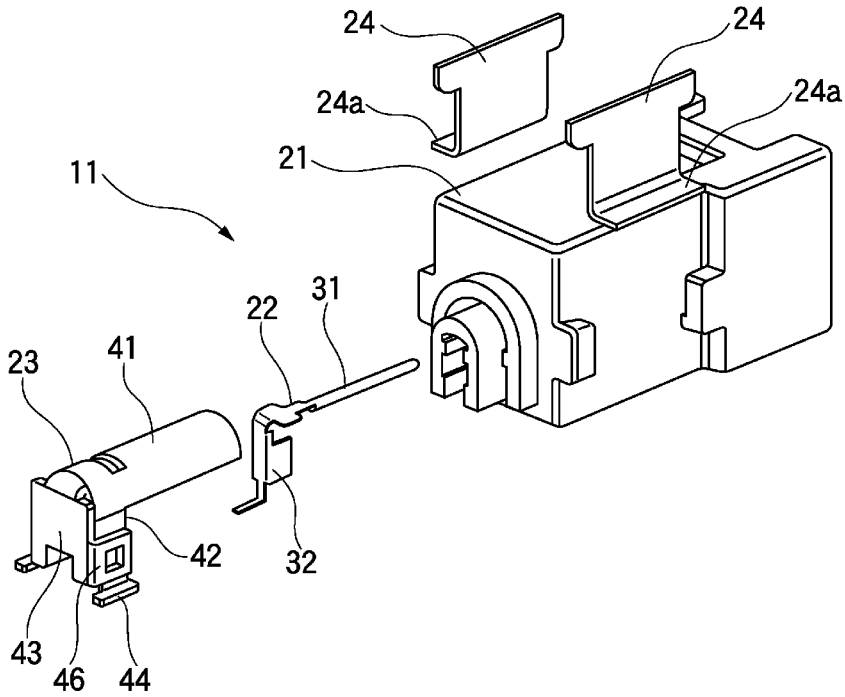
FIG. 2 is an exploded perspective view of the shielded connector for a substrate according to an illustrative embodiment of the invention.
Figure 3:
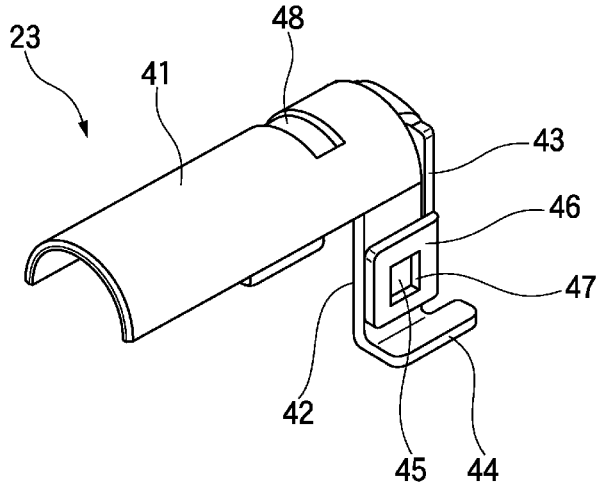
FIG. 3 is a perspective view of an outer conductor terminal according to an illustrative embodiment of the invention.
Figure 4C:
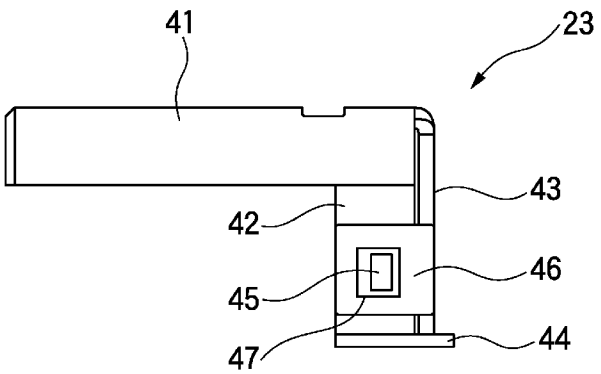
Figure 4A:
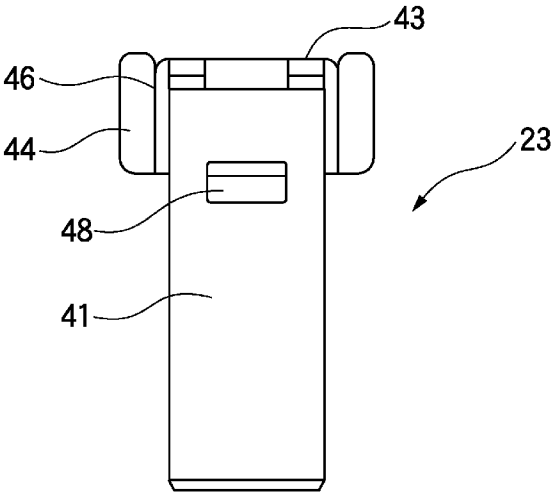
Figure 4B:
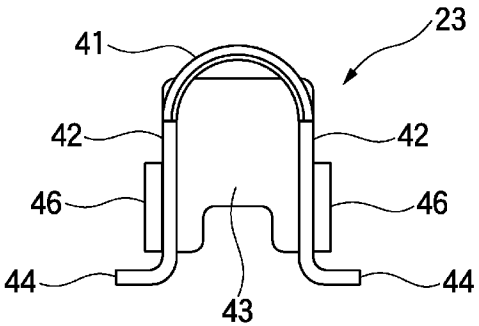
Figure 5:
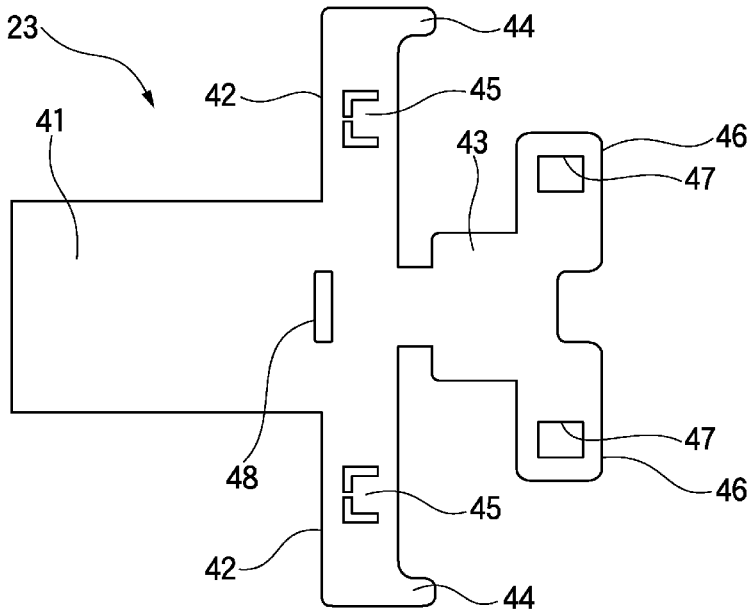
FIG. 5 is a development view of the outer conductor terminal.
Figure 6:
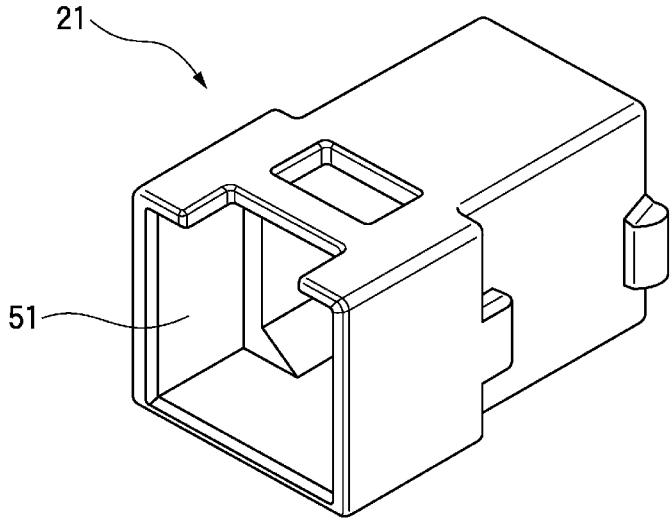
FIG. 6 is a perspective view of a housing configuring the shielded connector for a substrate.
Figure 7:
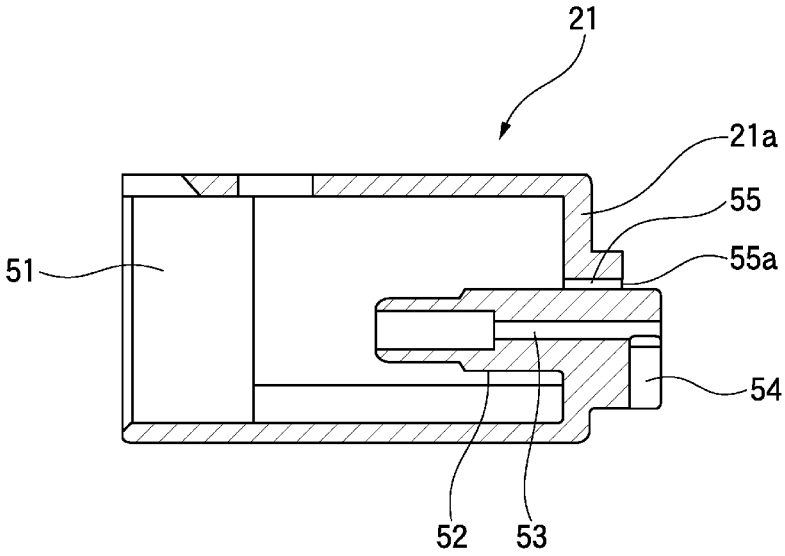
FIG. 7 is a sectional view of the housing configuring the shielded connector for a substrate.
Figure 8:
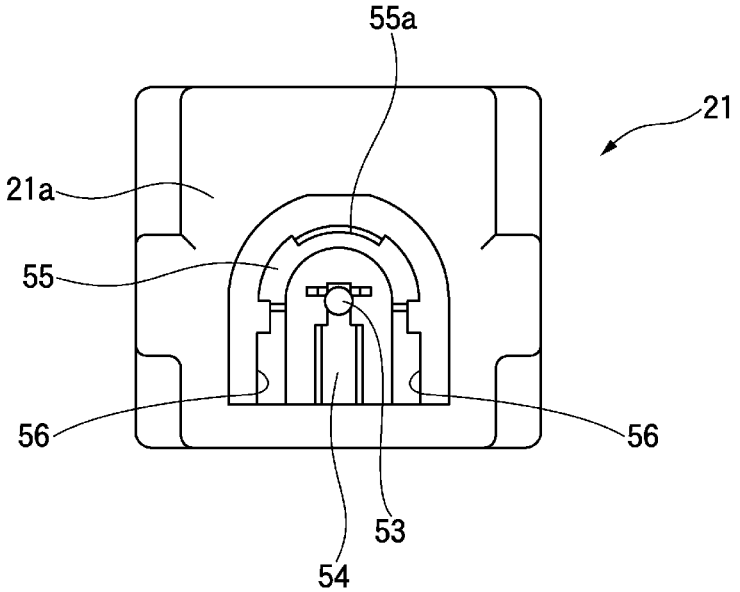
FIG. 8 is a rear view of the housing configuring the shielded connector for a substrate.
Figure 9:
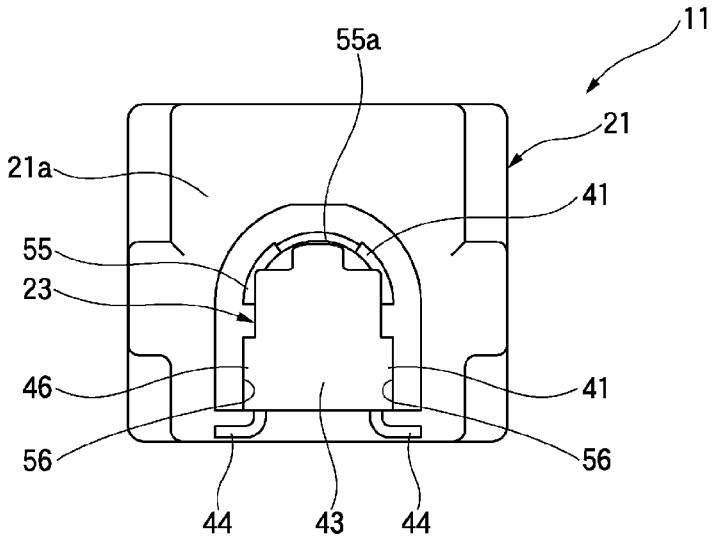
FIG. 9 is a rear view of the shielded connector for a substrate.
Figure 10:
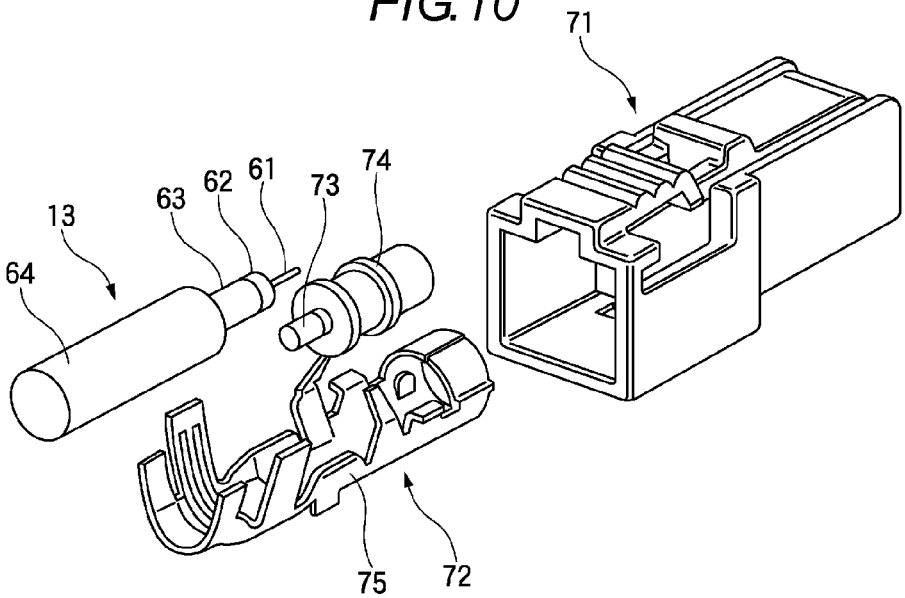
FIG. 10 is an exploded perspective view of the cable-side connector that is connected to the shielded connector for a substrate.

FIG. 1 is a perspective view of a shielded connector for a substrate and a cable-side connector that is connected to the shielded connector for a substrate according to an illustrative embodiment, FIG. 2 is an exploded perspective view of the shielded connector for a substrate according to an illustrative embodiment, FIG. 3 is a perspective view of an outer conductor terminal according to an illustrative embodiment, FIGS. 4A to 4C show a shape of the outer conductor terminal, in which FIG. 4A is a plan view, FIG. 4B is a front view and FIG. 4C is a side view, FIG. 5 is a development view of the outer conductor terminal, FIG. 6 is a perspective view of a housing configuring the shielded connector for a substrate, FIG. 7 is a sectional view of the housing configuring the shielded connector for a substrate, FIG. 8 is a rear view of the housing configuring the shielded connector for a substrate, FIG. 9 is a rear view of the shielded connector for a substrate and FIG. 10 is an exploded perspective view of the cable-side connector that is connected to the shielded connector for a substrate.

As shown in FIG. 1, a shielded connector (connector) 11 for a substrate according to an illustrative embodiment is mounted on a circuit substrate (substrate) 12 such as printed substrate. The shielded substrate 11 for a substrate is attached to the circuit substrate 12 by the surface mounting.

The shielded substrate 11 for a substrate is connected with a cable-side connector 14 attached to an end portion of a shielded cable 13.

As shown in FIG. 2, the shielded substrate 11 for a substrate has a housing 21 made of synthetic resin. The housing 21 is mounted with an inner conductor terminal 22 and an outer conductor terminal (terminal) 23. Also, the housing 21 is mounted with L-shaped fixing pegs 24 at both sides thereof. Each of the fixing piece portions 24*a* is provided at a lower end portion thereof with a fixing piece portion 24*a*. By fixing the fixing pegs 24 to the circuit substrate 12 with soldering and the like, the shielded substrate 11 for a substrate is attached to the circuit substrate 12.

The inner conductor terminal 22 has a connection pin portion 31 and a connection leg portion 32 that extends from a rear end of the connection pin portion 31 toward the circuit substrate 12 and is conductively connected to a conductor pattern (not shown) of the circuit substrate 12 by a soldering and the like.

As shown in FIGS. 3 and 4A to 4C, the outer conductor terminal 23 has a terminal main body 41 having an arc shape, when seen from a sectional view, a pair of first hanging-down parts 42 extending from both sides of the terminal main body 41, which are both ends in a width direction at rear ends of the terminal main body, toward the circuit substrate 12, and a second hanging-down part 43 hanging down from a rear end of the terminal main body 41, which is one end of the terminal main body in a longitudinal direction, toward the circuit substrate 12. The rear end side of the terminal main body 41 is covered by the second hanging-down part 43.

The first hanging-down parts 42 are respectively formed at lower end portions thereof with connection portions 44 that are bent outwards. The connection portions 44 are conductively connected to the conductor pattern of the circuit substrate 12, which is a ground, by the soldering and the like. Also, the first hanging-down parts 42 are respectively formed with engaging piece portions 45 in the vicinity of the lower end portions thereof, which are bent and protrude outwards.

The second hanging-down part 43 is a flat plate member having the substantially same width as an interval between first hanging-down parts 42 opposed to each other and end faces thereof at both sides in the width direction are flush with the first hanging-down parts 41, as shown in FIG. 3. The second hanging-down part 43 has, at both sides of the lower end portion thereof, pressing plate portions 46 extending toward a front end of the terminal main body 41. The respective pressing plate portions 46 of the second hanging-down part 43 are opposed to each other with contacting the outer surfaces of the first hanging-down parts 42. Thereby, the first hanging-down parts 42 are respectively pressed in an inner direction, which is an approaching direction of the first hanging-down parts, by the pressing plate portions 46 of the second hanging-down part 43, so that the outward widening is prevented.

Also, the pressing plate portions 46 of the second hanging-down part 43 have engaging holes 47. The engaging piece portions 45 of the first hanging-down parts 42 are engaged into the engaging holes 47. Thereby, the outward widening of the second hanging-down part 43 is prevented. Furthermore, since the engaging piece portions 45 of the first hanging-down parts 42 are engaged into the engaging holes 47, it is possible to keep a state where the second hanging-down part 43 is contacted to the first hanging-down parts 42 or a state where the second hanging-down part comes close to the first hanging-down parts to a maximum extent, as shown in FIG. 4C.

Also, the terminal main body 41 is formed with an engaging hole 48 at an upper part in the vicinity of the rear end thereof. A lance 55*a* of the housing 21, which will be described later, is engaged into the engaging hole 48, so that the outer conductor terminal 23 is engaged to the housing 21.

As shown in FIG. 5, the outer conductor terminal 23 is formed by perforating a metal plate and performing bending processing.

Specifically, first, the terminal main body 41 and the first hanging-down parts 42 are formed and the first hanging-down parts 42 are formed with the connection portions 44 and the engaging piece portions 45. Also, the pressing plate portions 46 of the second hanging-down part 43 are formed by bending processing. At this time, it is preferable to bend the pressing plate portions 46 by 90° or smaller.

Then, the second hanging-down part 43 is bent at a connection position with the terminal main body 41 and the respective pressing plate portions 46 are disposed so that they overlap the outer surfaces of the first hanging-down parts 41.

The first hanging-down parts 42 are pressed from the outer surfaces thereof by the pressing plate portions 46 of the second hanging-down part 43, so that the outward widening is prevented. At this time, since the pressing plate portions 46 of the second hanging-down part 43 are bent by 90° or smaller, the pressing plate portions securely press the first hanging-down parts 42 inwards against the reactive force from the first hanging-down parts 42.

Also, the engaging piece portions 45 are engaged into the engaging holes 47 of the pressing plate portions 46, so that the outward widening of the second hanging-down part 43 is prevented.

As shown in FIGS. 6 and 7, the housing 21 is opened at its leading end side and the cable-side connector 14 is connected to the opening 51.

The housing 21 is provided at a rear end portion thereof with a protrusion 52 that protrudes toward the leading end. As shown in FIG. 8, the protrusion 52 is formed with an accommodation hole 53 penetrating in the front-rear direction. The connection pin portion 31 of the inner conductor terminal 22 is inserted into the accommodation hole 53 from a rear end side thereof.

Also, the housing 21 is formed at the rear end with an accommodation recess 54. In the accommodation recess 4, the connection leg portion 32 of the inner conductor terminal 22 is arranged.

Also, a rear face plate part 21*a* of the housing 21 is formed with an arc-shaped insertion hole 55 conforming to an outer periphery of the protrusion 52 so that the insertion hole covers the upper side of the accommodation hole 53. In the insertion hole 55, the terminal main body 41 of the outer conductor terminal 23 is inserted. The insertion hole 55 is formed at a part thereof with a lance 55*a*. The lance 55*a* is engaged into the engaging hole 48 that is formed in the terminal main body 41 of the outer conductor terminal 23. Also, the rear face plate part 21*a* of the housing 21 is formed with engaging concave portions 56 at both sides of the accommodation recess 54. In the engaging concave portions 56, the first hanging-down parts 42 and the pressing plate portions 46 of the second hanging-down part 43, which configure the outer conductor terminal 23 and overlap each other, are fitted and accommodated.

The housing 21 is mounted with the outer conductor terminal 23 from the rear side of the housing. Specifically, the terminal main body 41 of the outer conductor terminal 23 is inserted into the insertion hole 55 of the housing 21 and is pushed into the leading end side of the housing 21 until the lance 55*a* is engaged into the engaging hole 48 of the terminal main body 41, so that the first hanging-down parts 41 and the pressing plate portions 46 of the second hanging-down part 43 are fitted in the engaging concave portions 56.

Thus, in the housing 21, the terminal main body 41 of the outer conductor terminal 23 is arranged on a circumference of the protrusion 52. Also, as shown in FIG. 9, the first hanging-down parts 42 and the pressing plate portions 46 of the second hanging-down part 46 are accommodated in the engaging concave portions 56. Thereby, the outer conductor terminal 23 is accommodated in the housing 21 without rattling.

Also, when the outer conductor terminal 23 is mounted to the housing 21 as described above, the surrounding of the inner conductor terminal 22 is covered by the first hanging-down parts 42 and the second hanging-down part 43 of the outer conductor terminal 23.

The shielded connector 11 for a substrate is surface-mounted on the circuit substrate 12 by a reflow way. Specifically, the heating is performed with the shielded connector 11 for a substrate being arranged on a predetermined position of the circuit substrate 12, so that the solder on the conductor pattern is melted. Thereby, the fixing piece portions 24*a* of the fixing pegs 24 at both sides of the housing 21, the connection leg portion 32 of the inner conductor terminal 22 and the connection portions 44 of the outer conductor terminal 23 are soldered on the conductor pattern of the circuit substrate 12. As a result, the shielded connector 11 for a substrate is surface-mounted on the circuit substrate 12.

As shown in FIG. 10, the shielded cable 13 to which the cable-side connector 14 is connected has a core wire 61, an insulation layer 62 that is extruded and covered onto the core wire 61, an outer conductor 63 that is provided around the insulation layer 62 and a sheath 64 that is covered around the outer conductor 63.

The cable-side connector 14 has a housing 71 made of synthetic resin, and a shielded terminal 73 is accommodated in the housing 71. The shielded terminal 72 has a cylindrical inner terminal 73 that is crimped and fixed to the core wire 61, an insulator 74 that is provided on an outer periphery of the inner terminal 73 and an outer terminal 75 that is provided on the outer periphery of the inner terminal 73 via the insulator 74 so that it is conductively connected to the outer conductor 63.

When the cable-side connector 14 is inserted from the opening 51 of the housing 21 and is thus connected to the shielded connector 11 for a substrate, the connection pin portion 31 of the inner conductor terminal 22 is inserted to the inner terminal 73, so that they are conductively connected to each other. Also, the protrusion 52 is inserted into the outer terminal 75, so that the outer terminal 75 overlaps the outer periphery of the terminal main body 41 of the outer conductor terminal 23 arranged around the protrusion 52 and thus the outer terminal 75 and the outer conductor terminal 23 are conductively connected to each other.

Thereby, the core wire 61 of the shielded cable 13 is conductively connected to the predetermined conductor pattern of the circuit substrate 12 via the inner conductor terminal 22. Also, the outer conductor 63 of the shielded cable 13 is conductively connected to the conductor pattern of the ground of the circuit substrate 12 via the outer conductor terminal 23.

Also, since the inner conductor terminal 22 is covered by the first hanging-down parts 42 and the second hanging-down part 43 of the outer conductor terminal 23, it is possible to secure the favorable shield effect.

As described above, according to the above illustrative embodiment, the pair of first hanging-down parts 42 that is connected to the circuit substrate 12 is held by the pressing plate portions 46 of the second hanging-down part 43. Therefore, when surface-mounting the shielded connector for a substrate on the circuit substrate 12, it is possible to position the first hanging-down parts 42 smoothly and precisely without the rattling.

Also, the engaging piece portions 45 are engaged into the engaging holes 47, so that it is possible to prevent the rattling of the second hanging-down part 43 and to perform the surface mounting onto the circuit substrate 12 while positioning the first hanging-down parts more smoothly and precisely.

Also, the pressing plate portions 46 overlapping the first hanging-down parts 42 are fitted and held in the engaging concave portions 56 of the housing 21 without the rattling. Hence, it is possible to further prevent the rattling of the first hanging-down parts 42. Also, it is possible to prevent the rattling of the outer conductor terminal 23 with respect to the housing 21 and to position and surface-mount the shielded connector on the circuit substrate 12 smoothly and precisely.

In the meantime, the invention is not limited to the above illustrative embodiment. The above illustrative embodiment can be appropriately modified and improved. The materials, shapes, sizes, the number, arrangement positions and the like of the respective constitutional elements in the illustrative embodiment are arbitrary and are not particularly limited insomuch as they can achieve the invention.

What is claimed is:

1. A terminal of a connector which is surface-mounted on a substrate, the terminal comprising:

a terminal main body;

a pair of first hanging-down parts extending from both sides of the terminal main body toward the substrate and being connected to a conductor pattern of the substrate; and a second hanging-down part hanging down from one end of the terminal main body toward the substrate, wherein the second hanging-down part has a pair of pressing plate portions which are bent toward the first hanging-down parts and is arranged to face each other with overlapping and contacting the first hanging-down parts.

2. The terminal according to claim 1, wherein the pressing plate portions are formed with engaging holes, and the first hanging-down parts are formed with engaging piece portions which are engaged into the engaging holes.

3. A connector accommodating the terminal according to claim 1 in a housing thereof, wherein the housing has engaging concave portions in which the pressing plate portions overlapping the first hanging-down parts are fitted.

* * * * *